US006289641B1

(12) United States Patent
McCandless

(10) Patent No.: US 6,289,641 B1
(45) Date of Patent: Sep. 18, 2001

(54) GLAZING UNIT HAVING THREE OR MORE SPACED SHEETS AND A SINGLE SPACER FRAME AND METHOD OF MAKING SAME

(75) Inventor: Jack B. McCandless, Natrona Heights, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 95 days.

(21) Appl. No.: 09/016,535

(22) Filed: Jan. 30, 1998

(51) Int. Cl.[7] ..... E04B 7/12

(52) U.S. Cl. ..... 52/172; 52/204.593; 52/204.7; 52/786.11; 52/786.13

(58) Field of Search ..... 52/172, 204.591, 52/204.593, 204.595, 204.6, 204.69, 204.7, 786.1, 786.11, 786.13, 800.14

(56) References Cited

U.S. PATENT DOCUMENTS

| | | | | |
|---|---|---|---|---|
| 2,641,031 | * | 6/1953 | Ehret | 52/204.593 X |
| 2,934,800 | * | 5/1960 | Hasbrouck et al. | 52/204.593 X |
| 3,040,847 | * | 6/1962 | Webster | 52/204.7 X |
| 3,837,129 | * | 9/1974 | Losell | 52/786.11 X |
| 4,170,460 | | 10/1979 | Donley . | |
| 4,239,816 | | 12/1980 | Breininger et al. . | |
| 4,376,359 | * | 3/1983 | Redman | 52/204.591 X |
| 4,462,884 | | 7/1984 | Gillery et al. . | |
| 4,610,711 | | 9/1986 | Matesa et al. . | |
| 4,692,389 | | 9/1987 | Gillery et al. . | |
| 4,703,598 | * | 11/1987 | Wilson et al. | 52/204.591 X |
| 4,719,127 | | 1/1988 | Greenberg . | |
| 4,792,536 | | 12/1988 | Pecoraro et al. . | |
| 4,806,220 | | 2/1989 | Finley . | |
| 4,853,256 | | 8/1989 | Obringer et al. . | |
| 4,853,257 | | 8/1989 | Henery . | |
| 4,873,206 | | 10/1989 | Jones . | |
| 4,898,789 | | 2/1990 | Finley . | |
| 5,030,593 | | 7/1991 | Heithoff . | |
| 5,177,916 | | 1/1993 | Misera et al. . | |
| 5,240,886 | | 8/1993 | Gulotta et al. . | |
| 5,313,761 | | 5/1994 | Leopold . | |
| 5,356,718 | | 10/1994 | Athey et al. . | |
| 5,377,473 | | 1/1995 | Narayan et al. . | |
| 5,531,047 | | 7/1996 | Leopold et al. . | |
| 5,553,440 | | 9/1996 | Bulger et al. . | |
| 5,644,894 | | 7/1997 | Hudson . | |
| 5,655,282 | | 8/1997 | Hodek et al. . | |

FOREIGN PATENT DOCUMENTS

| | | |
|---|---|---|
| 1908567 | 9/1969 | (DE) . |
| 4226883 | 3/1993 | (DE) . |
| 0 403 058 | 12/1990 | (EP) . |
| 0 475 213 | 3/1992 | (EP) . |
| 2350436 | 12/1977 | (FR) . |
| 2492880 | 4/1982 | (FR) . |

OTHER PUBLICATIONS

Arasteh, D. et al., "The Design and Testing of a Highly Insulating Glazing System for Use With Conventional Window Systems", *Transactions of the ASME, Journal of Solar Energy Engineering*, Feb. 1989, vol. III, pp. 44–53.

Selkowitz, Stephen E. et al., United States Statutory Invention Registration No. H975, entitled "Thermal Insulated Glazing Unit", published Nov. 5, 1991.

* cited by examiner

*Primary Examiner*—Richard Chilcot
(74) *Attorney, Agent, or Firm*—Donald C. Lepiane

(57) ABSTRACT

A multi-sheet glazing unit includes a spacer frame having a pair of legs joined to a base to provide a U-shaped cross-section. A sheet e.g. glass sheet is secured by a moisture-impervious adhesive to the outer surface of each of the legs of the spacer frame. A plurality of sheet retaining members in a spaced relationship to one another is maintained on the legs of the spacer frame between the glass sheets and spaced from the base. The sheet retaining members each have a pair of flexible fingers mounted on a platform member, angled away from the platform member toward one another and spaced above the platform member. A sheet mounted between the fingers is maintained spaced from the outer sheets. A method for making the unit is also disclosed.

26 Claims, 5 Drawing Sheets

GLAZING UNIT HAVING THREE OR MORE SPACED SHEETS AND A SINGLE SPACER FRAME AND METHOD OF MAKING SAME

FIELD OF THE INVENTION

This invention relates to a multi-sheet glazing unit and, in particular, to a multi-sheet glazing unit having a pair of outer glass sheets separated by and secured to a spacer frame and one or more glass sheet(s) between and spaced from the outer sheets and one another by sheet retaining members, and to a method of making a multi-sheet glazing unit.

BACKGROUND OF THE INVENTION

European Patent Application Publication Number 0 475 213 A1 published Mar. 18, 1992 Bulletin 92/12 (hereinafter "EP Application") and U.S. Pat. No. 5,655,282 (hereinafter "U.S. Pat. No. '282") disclose a thermal insulating glazing unit having three or more sheets with a spacer frame between and adhered to adjacent glass sheets. Although the techniques for making insulating glazing units having three or more sheets disclosed in the EP Application and U.S. Pat. No. '282 are acceptable, it would be advantageous to provide a multi-sheet glazed unit that does not have a spacer frame between adjacent glass sheets thereby reducing the number of spacer frames required in the fabrication of such units.

U.S. Pat. No. 5,531,047 (hereinafter "U.S. Pat. No. '047") discloses multi-sheet glazing units having one or more inner glass sheets spaced from and between a pair of outer glass sheets. In general, the outer glass sheets are separated by and secured to a spacer frame having a U-shaped cross section. On the base of the spacer frame between the outer legs is a layer of a pliable material having one or more groove(s) for receiving edge portions of the inner glass sheet(s). The unit of U.S. Pat. No. '047 is fabricated by wrapping spacer stock around the inner sheet(s) while positioning the edge portions of the inner sheet(s) in the groove(s) of the pliable material to position the inner sheet(s) within the spacer frame. After the inner sheet(s) is(are) within the spacer frame, the outer sheets are secured to the outer surfaces of the spacer frame by a moisture-impervious sealant. Although the techniques disclosed in U.S. Pat. No. '047 are acceptable, there are limitations. For example, positioning the spacer stock around the inner sheet(s) may disturb the pliable material on the base of the spacer frame, making the unit unsightly. Further mounting the inner sheet(s) in the pliable material on the base of the spacer stock requires time and mounting precision.

U.S. Pat. No. 5,644,894 (hereinafter "U.S. Pat. No. '894") discloses multi-sheet glazing units having one or more inner glass sheet(s) mounted within a U-shaped spacer frame and outer sheets adhered to outer surfaces of the spacer frame by a moisture-impervious sealant. The inner sheet(s) is(are) held in position by spaced rows of raised portions formed in the base of the spacer frame. Although the insulating or glazing units disclosed in U.S. Pat. No. '894 are acceptable, there are limitations. More particularly, providing spaced rows of raised portions in the base of the spacer frame requires an extra step in the process of making the spacer frame.

U.S. Pat. No. 5,553,440 (hereinafter "U.S. Pat. No. '440") also discloses multi-sheet glazing units having three or more glass sheets. In general, the units include a pair of outer glass sheets separated by and adhered to outer opposed surfaces of a spacer frame having a U-shaped cross-section. A sheet retaining member mounted between the upright legs of the spacer frame has one or more groove(s) for receiving marginal and peripheral edge portions of one or more inner sheet(s). Although the glazing units taught in U.S. Pat. No. '440 are acceptable, there are limitations. More particularly, wrapping the spacer stock around the inner sheet(s) while positioning the edge of the inner sheet(s) in the groove(s) of the sheet retaining members requires assembly time and precision.

United States Statutory Invention Regulation No. H975 (hereinafter "Publication H975"), published Nov. 5, 1991, discloses a multi-sheet unit having a pair of outer sheets spaced from one another by and secured to a spacer frame. An example of Publication H975 discloses the construction of the unit by mounting the edge supports on the edge portions of an inner sheet and setting the inner sheet having the edge supports within the closed spacer frame. Thereafter, the edge supports are secured to the frame. As can be appreciated, mounting edge supports on the edges of an inner sheet and thereafter, securing the edge supports to the spacer frame is time consuming.

As can now be appreciated, it would be advantageous to provide multi-sheet glazing units, i.e., glazing units having three or more sheets, and methods of making same that do not have the limitations of presently available multi-sheet insulating or glazing units and methods of making same.

SUMMARY OF THE INVENTION

This invention relates to a sheet retaining member having a finger mounted on each side of a pair of opposite sides of a support member. The fingers are flexible for movement toward and away from the support member and the ends of the fingers are spaced from one another to engage marginal edge portions of a sheet therebetween.

This invention also relates to multi-sheet glazing units, i.e., a glazing unit having three or more sheets. The multi-sheet unit includes a spacer frame having opposed legs and a base connected to one another to have a generally U-shape. A sheet is mounted in any usual manner on outer surface of each of the legs of the spacer frame, e.g., by a moisture-impervious sealant. Support facilities of a sheet retaining member are mounted on the spacer frame spaced from the base. The sheet retaining member further includes a flexible finger mounted on each end of a pair of opposite sides of the support means; the finger extends over the surface of the support facilities toward one another into engagement with a sheet between the outer sheets.

The invention further relates to a method of making a multi-sheet glazing unit. The method includes, among other steps, the following steps. A spacer and a plurality of sheet retaining members are provided. At least one of the sheet retaining members has a finger mounted on each side of a pair of opposed sides of a support facility. The fingers are flexible for movement toward and away from the support facilities and extend over the surface of the support facilities toward one another. The support facilities of the sheet retaining members are mounted on the spacer frame spaced from one another with the fingers in the raised position i.e. unbiased position facing the interior of the spacer frame. A sheet is moved into the interior of the spacer frame moving a finger. Continued movement of the inner sheet engages the other finger and moves the edge of the inner sheet past the end of the fingers in the biased position. The fingers clear of the edge of the inner sheet move to position to retain the inner sheet between the fingers. An outer sheet is secured on each side of opposed sides of the spacer frame to provide the multi-sheet unit having outer sheets and inner sheet(s) spaced from one another.

DESCRIPTION OF THE INVENTION

The various embodiments of the instant invention will be discussed in the construction of a multi-sheet thermally insulating or glazing unit having a low thermal conducting edge determined as disclosed in the EP Application and U.S. Pat. No. '282 which disclosures are hereby incorporated by reference. As will be appreciated, the instant invention is not limited to a multi-sheet glazing unit that is thermally insulating and/or has a low thermal conductivity edge, and the embodiments of the present invention may be used with a multi-sheet glazing unit regardless of its thermal insulating properties, if any. In the following discussion, unless otherwise indicated, like numerals refer to like elements.

Figure 1:
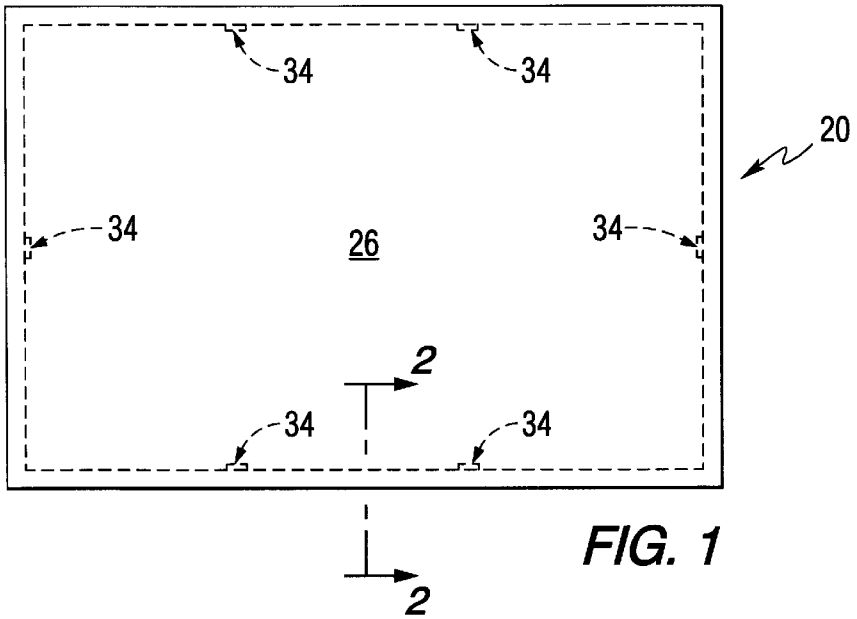
FIG. 1 is a front elevated view of a multi-sheet glazing unit incorporating features of the invention.
Figure 2:
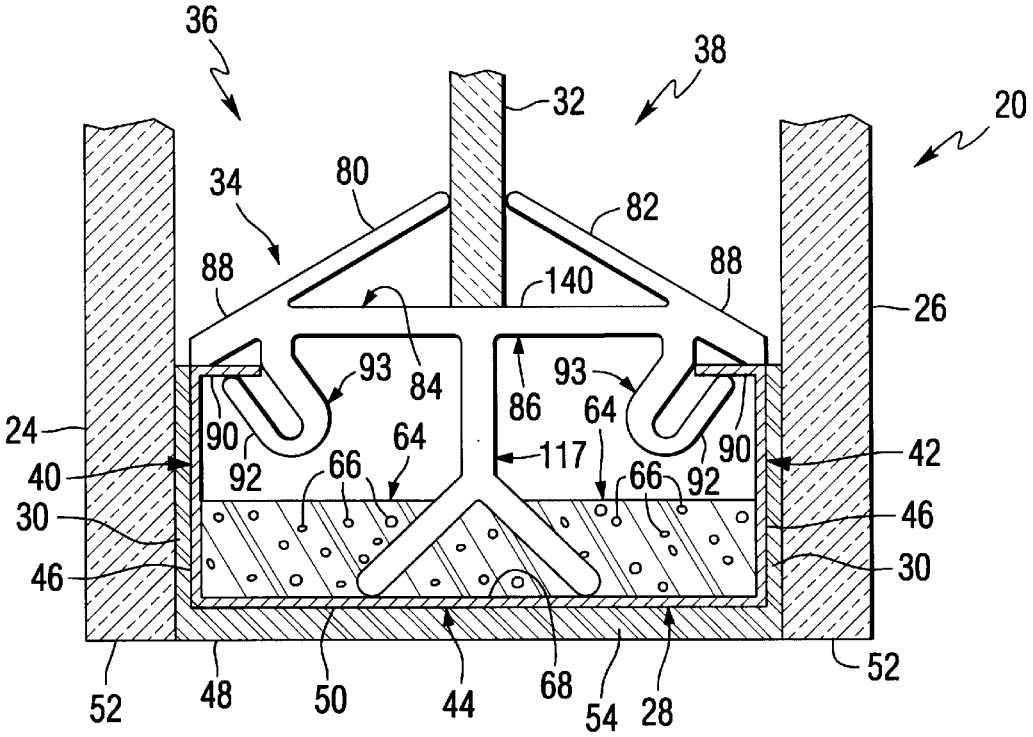
FIG. 2 is the view taken along lines 2—2 of FIG. 1.

FIG. 1 shows a multi-sheet glazing unit 20 incorporating features of the invention, and FIG. 2 shows a cross-sectional view of the multi-sheet unit 20. With specific reference to FIG. 2, the unit 20 has a pair of outer sheets 24 and 26 secured to a spacer frame 28 by a layer 30 of an adhesive, and an inner or intermediate sheet 32 held in position between the outer sheets 24 and 26 by sheet engaging members 34 (one only shown in FIG. 2) incorporating features of the invention to provide a compartment 36 between the sheets 24 and 32, and a compartment 38 between the sheets 26 and 32. Preferably, but not limiting to the invention, the compartments 36 and 38 are sealed against the egress and ingress of the atmosphere outside the compartments, e.g., gases, moisture and/or dust (hereinafter individually and collectively referred to as "environmental atmosphere") by the adhesive layers 30 discussed in more detail below.

In the following discussion, the sheets 24, 26 and 32 are glass sheets; however, as will become apparent, the sheets may be made of any material, e.g., glass, plastic, metal and/or wood, and the selection of the material of the sheets is not limiting to the invention. Further, the sheets may be made of the same material or the sheets may be made of different materials. Still further, one sheet may be a monolithic sheet, and the other sheet(s) may be laminated sheet(s), e.g., made of one or more monolithic sheets laminated together in any usual manner. One or more of the surfaces of one or more sheets may have an environmental coating to selectively pass predetermined wavelength ranges of light and energy, e.g., glass or plastic transparent sheets may have an opaque coating of the type used in making spandrels or the type of coatings disclosed in U.S. Pat. Nos. 4,170,460; 4,239,816; 4,462,884; 4,610,711; 4,692,389; 4,719,127; 4,806,220; 4,853,257; 4,898,789 and 5,356,718, which disclosures are hereby incorporated by reference.

Further, in the practice of the invention, one or more of the glass sheets may be coated and/or uncoated colored sheets, e.g. but not limiting to the invention, colored sheets of the type disclosed in U.S. Pat. Nos. 4,873,206; 4,792,536; 5,030,593 and 5,240,886, which disclosures are hereby incorporated by reference. Still further, in the practice of the invention, the surfaces of the sheets may have a photocatalytic cleaning film or water reducing film, e.g., of the type disclosed in U.S. patent application Ser. No. 08/927,130 filed on Sep. 2, 1997, in the name of James P. Thiel for PHOTOELECTRICALLY-DESICCATING MULTIPLE-GLAZED WINDOW UNITS and U.S. patent application Ser. No. 08/899,257 filed on Jul. 23, 1997, in the names of Charles B. Greenberg et al., for PHOTOCATALYTICALLY-ACTIVATED SELF-CLEANING ARTICLE AND METHOD OF MAKING SAME, which disclosures are hereby incorporated by reference. The photocatalytic film disclosed in U.S. patent application Ser. No. 08/899,257 is preferably deposited on the outer surface of one or both sheets 24 and 26; however, the invention contemplates depositing the photocatalytic film on the inner surface of one or both sheets 24 and 26 and/or surfaces of the inner sheet 32. The water reducing film disclosed in U.S. patent application Ser. No. 08/927,130 is preferably deposited on one or more of the surfaces of the inner sheet(s) 32 or the inner surface of one or more of the outer sheets 24 and 26; however, the invention contemplates depositing the coating on the outer surface of one or both sheets 24 and 26.

The outer glass sheets 24 and 26 preferably have the same peripheral configuration and dimensions; however, as can be appreciated, one outer glass sheet may be larger than the other outer glass sheet. Further, one or more of the sheets 24, 26 and 32 may have different peripheral configurations than the remaining sheet(s).

With continued reference to FIG. 2, and not limiting to the invention, the spacer frame 28 has a generally U-shaped cross section defined by a pair of spaced legs 40 and 42 secured to a base 44 to have a generally "U" shape. The adhesive layer 30 is preferably a moisture-impervious material e.g. adhesive-sealant of the type used in the art of sealing compartments of insulating units. The layer 30 is provided on outer surface 46 of the legs 40 and 42 of the spacer frame 28 to secure the outer sheets 24 and 26 to the legs 40 and 42, respectively, of the spacer frame 28 to seal the compartments 36 and 38 against movement of environmental atmosphere into and out of the compartments.

It can now be appreciated that the material of the adhesive-sealant layers 30 is not limiting to the invention and is preferably a material that is gas and/or moisture impervious to prevent the ingress of environmental atmosphere into the compartment between the sheets. The material for layers 30 preferably has a moisture permeability of less than about 20 grams millimeter (hereinafter "gm mm")/square meter (hereinafter "$M^2$") day, and more preferably less than about 5 gm mm/$M^2$ day, determined using the procedure of ASTM F 372-73. materials that may be used in the practice of the invention include, but are not limited to, butyls, silicones, polyurethane adhesives, and butyl hot melts of the type sold by H. B. Fuller, e.g., H. B. Fuller 5140. Units filled with an insulating gas, e.g., argon, preferably have the adhesive-sealant layers 30 of a moisture and/or gas impervious material to maintain the insulating gas in the compartments 36 and 38.

It is recommended that the adhesive-sealant layer 30 be thin and long to reduce the diffusion of the insulating gas out of or the environmental atmosphere moving into the compartments of the unit. More particularly, increasing the thickness of the layer 30, i.e., the distance between the glass sheet and the adjacent leg of the spacer frame, while keeping all other parameters constant increases the diffusion rate, and increasing the length of the layer 30, i.e., the distance between the top of the leg of the spacer frame and the base of the spacer frame as viewed in FIG. 2, while keeping all other parameters constant decreases the diffusion rate of gas through the adhesive-sealant layer 30. The invention may be practiced with the adhesive-sealant layers 30 each having a thickness of about 0.005 inch (0.013 centimeter, hereinafter "cm") to about 0.125 inch (0.32 cm), preferably about 0.010 inch (0.025 cm) to about 0.020 inch (0.050 cm) and more preferably, about 0.015 inch (0.38 cm), and the layers 30 each having a length of about 0.010 inch (0.025 cm) to about 0.50 inch (1.27 cm), preferably about 0.125 inch (0.32 cm) to about 0.50 inch (1.27 cm) and more preferably about 0.200 inch (0.50 cm).

With respect to the loss of the insulating gas, e.g., argon, from the compartments 36 and 38, the thickness and length of the layers 30 are chosen in combination with the gas permeability of the adhesive-sealant layers 30 so that the rate of loss of the insulating gas matches the desired unit performance lifetime. Preferably, the rate of loss of the insulating gas should be less than about 5% per year and, more preferably, it should be less than about 1% per year determined as described in the EP Application and U.S. Pat. No. '282.

A layer 48 of an adhesive, sealant or adhesive-sealant may be provided over outer surface 50 of the base 44 is of the spacer frame 28. The layer 48 may be a material similar or dissimilar to the material of the layers 30. It is preferred that the material of the layer 48 be non-tacky so that the peripheral edges of the multi-sheet unit 20 do not stick to surfaces supporting the edge of the unit. Further, in the practice of the invention, multi-sheet units having the layer 48, preferably have the outer surface 50 of the base 44 of the spacer frame 28 recessed inwardly from the peripheral edges 52 of the outer sheets 24 and 26 as viewed in FIG. 2 to provide a channel 54 to receive the layer 48. The thickness of the layer 48 is not limiting to the invention, and the layer 48 may have a thickness of about 0.031 inch (0.08 cm) to about 0.50 inch (1.27 cm), preferably a thickness of about 0.150 inch (0.38 cm). The layer 48 preferably has similar moisture and gas permeability values as the layers 30. As can now be appreciated and with reference to FIG. 3, the instant invention contemplates multi-sheet units without the peripheral channel 54 and layer 48 as shown for multi-sheet unit 60 in FIG. 3. The outer surface 50 of the base 44 of the spacer frame 28 for the unit 60 shown in FIG. 3 may be in alignment with the peripheral edges 52 of the outer sheets 24 and 26 or may be recessed as shown in FIG. 2, or the base of the spacer frame may extend beyond the peripheral edges 52 of the sheets 24 and 26 as shown in FIG. 4.

The spacer frame may be made of any material, e.g., wood, plastic, metal coated plastic, metal (e.g., stainless steel, galvanized iron or tin coated steel), or aluminum. Although the spacer frame may be made of any material, it is preferred that the spacer frame used in the practice of the instant invention have low thermal conductivity so that the spacer frame 28, the adhesive-sealant layers 30 and the layer 48, if present, collectively define an edge assembly that separates the outer sheets 24 and 26, and has a low thermal conductivity or high RES-value. Further, in the practice of the invention, it is preferred to use a spacer frame made of a material that is moisture and/or gas impervious e.g. but not is limited to metal, e.g., stainless steel, halogenated polymeric material, and/or a gas-pervious material covered with an impervious film, e.g., metal or polyvinylidene chloride film.

The EP Application and U.S. Pat. No. '282 discuss in detail the concept of edge assemblies having low thermal conductivity and determination of RES-value and reference may be made thereto for a detailed discussion.

Although the invention is not limited to the cross sectional configuration of the spacer frame, it is preferred in the practice of the invention to use a spacer frame having a U-shaped cross section, e.g., of the type shown in FIGS. 2 and 3, to secure the sheet retaining member 34 of the instant invention in position in a manner to be discussed below. In the practice of the invention, the spacer frame may have a generally U-shape cross section as shown for spacer frame 28 of FIGS. 2 and 3; a generally rectangular cross section as shown for spacer frame 62 of FIG. 4, or a W-shaped crosssection as shown in U.S. Pat. No. 5,377,473. Further, in the practice of the invention the spacer frame is a closed spacer frame made from a continuous piece of spacer stock as disclosed in U.S. Pat. No. 5,177,916 (hereinafter "U.S. Pat. No. '916"); however, as can be appreciated, the invention is not limited thereto and may be made from sections of spacer stock, e.g., of the type disclosed in the EP Application and U.S. Pat. No. '282 and joined together by corner keys or welding sections.

Referring back to FIG. 2, one or more bead(s) 64 of a moisture-pervious material having a desiccant 66 therein is provided on inner surface 68 of the base, i.e., the surface of the base between the legs of the spacer frame. The bead(s) 64 may be made of any moisture-pervious material. Although the invention is not limited thereto, moisture-pervious materials having a permeability greater than about 2 gm mm/$M^2$ day as determined by the procedure set out in ASTM F 372-73 are recommended in the practice of the invention. Such materials are disclosed in the U.S. Pat. Nos. 5,177,916; 5,531,047 and 5,655,282, which patents are hereby incorporated by reference.

As can be appreciated, having a water reducing film disclosed in U.S. patent application Ser. No. 08/927,130 on selected surfaces of the inner surfaces of outer sheets 24 and 26 and surfaces of inner sheet 32 may be used to reduce the amount of desiccant required in the bead 64 or eliminate the need for the desiccant and the bead.

As can now be appreciated, the bead 64 may be used in the hollow rectangular spacer 62 shown in FIG. 4 or loose desiccant 66 may be provided in the hollow rectangular spacer or the desiccant eliminated.

Figure 5:
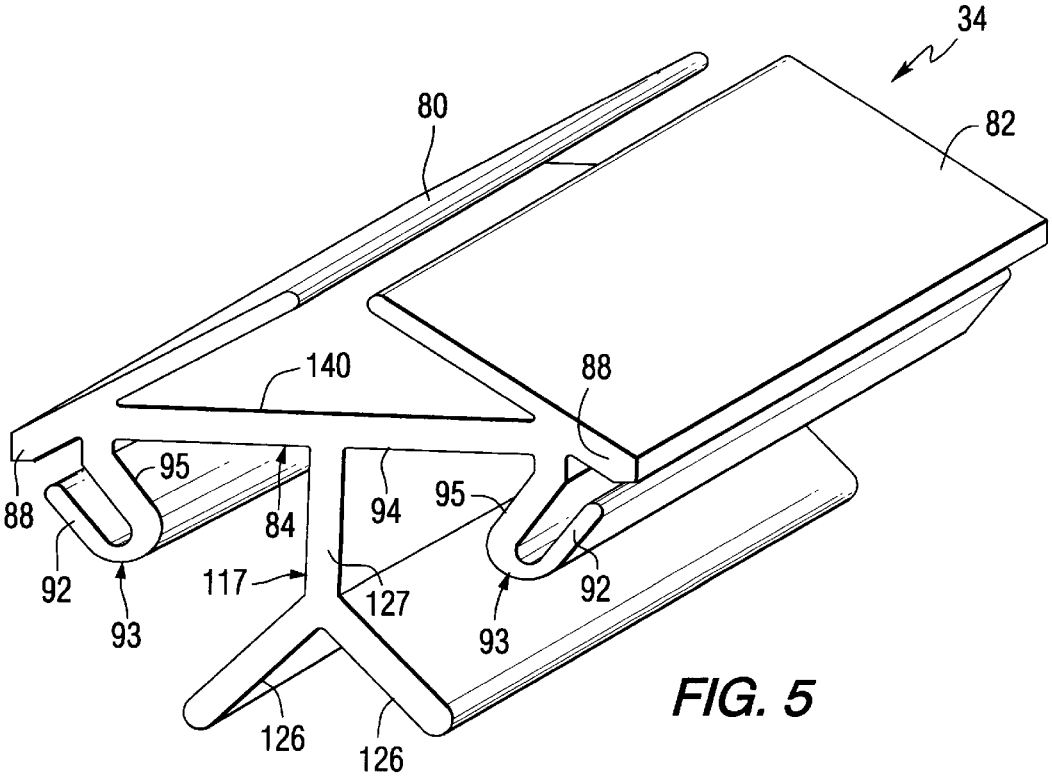
FIG. 5 is an isometric view of a sheet retaining member incorporating features of the invention.

The discussion will now be directed to sheet retaining member incorporating features of the instant invention. With reference to FIGS. 2 and 5 and with specific reference to FIG. 5, sheet retaining member 34 has a plurality of fingers 80 and 82 mounted to support platform or facilities 84 as shown in FIG. 5 to engage and/or capture the inner sheet 32 therebetween as shown in FIG. 2. The support platform 84 includes extensions 88 which rest on upper portions of the legs 40 and 42 of the spacer frame as shown in FIG. 2.

Although not limiting to the invention, ends 90 of the legs 40 and 42 of the spacer frame 28 are bent toward one another and captured between the extensions 88 and flexible fingers 92 as shown in FIG. 2. The flexible finger 92 is a finger of U shaped member 93 attached to bottom surface 94 of the support platform 84. The other finger designated by numeral 95 is less flexible i.e. more rigid than the finger 92 and is attached to the bottom surface 94 of the support platform 84. The support member 84 and fingers 92 and 95 are sized and shaped such that moving the sheet retaining member 34 between ends 90 of the legs 40 and 42 of the spacer frame, biases the finger 92 toward the finger 95. Continued downward motion of the sheet retaining member 34 as viewed in FIG. 2 seats the extensions 88 of the support member 84 on the ends 90 of the legs 40 and 42 of the spacer frame as viewed in FIG. 2 and the ends 90 of the legs 40 and 42 disengage the fingers 92 allowing them to move under the ends to capture the sheet retaining member on the spacer frame.

With continued reference to FIG. 5, the fingers 80 and 82 are spaced from one another to receive the inner sheet 32 therebetween in a manner to be discussed below.

As can be appreciated, the invention is not limited to the material of the sheet retaining member of the invention. For example, the sheet retaining member may be made of plastic, rubber, metal, wood, glass and/or reinforced plastic. In the practice of the invention it is preferred that the sheet retaining member be made of plastic because it is thermally non-conductive and economic to form. As can further be appreciated by those skilled in the art, the material of the sheet retaining member should be selected or prepared so that there is no outgassing of the material during use.

The sheet retaining member 34 may be mounted on the spacer frame in any usual manner. For example, as discussed above and shown in FIG. 2, the fingers 92 and extensions 88 cooperate with one another to capture the ends 88 of the legs 40 and 42 of the spacer frame 28. Sheet retaining member 114 incorporating features of the invention shown in FIG. 4 does not have the U-shaped members 93 e.g. on the underside 94 of the support platform 84. Support platform 115 of the sheet retaining member 114 is flat. The support platform 115 of the sheet retaining member 114 may be mechanically or adhesively secured at 116 to the rectangular cross-sectional spacer frame 62 as shown in FIG. 4.

In the instance where the sheet retaining member of the instant invention is used with a U-shaped spacer frame, e.g., the spacer frame 28, and the inner sheet 32 has significant weight or more than one inner sheet is used, a support shim 117 may be used as shown in FIG. 2 to prevent the edge retaining member from dropping between the legs of the spacer frame. The support shim 117 may be made of any structurally stable material and is preferably made of plastic. As shown in FIGS. 2 and 5, and more clearly in FIG. 5, the support shim 117 has an inverted Y shape with legs 126 resting on the base 44 of the spacer frame and the leg 127 connected or in surface contact with the underside 94 of the support platform 84. When the support shim 116 and the bead 64 having the desiccant 66 are used, the bead 64 may be provided on each side of the shim or the shim may be pushed into the moisture-pervious matrix of the bead if it is sufficiently soft at room temperature. One type of moisture pervious matrix that is soft at room temperature is PRC 525DM sold by Courtaulds Aerospace. As can be appreciated, the size of the shim is not limiting to the invention and may extend into contact with the legs 40 and 42 of the spacer frame 28.

In the practice of the invention, the sheet retaining member may extend along each elongated side of the spacer frame or along any selected elongated side(s) of the spacer frame. In the instance where a plurality of sheet retaining members are used along an elongated side of the spacer frame, it is suggested that a sheet retaining member be used at the midpoint of an elongated side of the spacer frame when the elongated side is less than about 2 feet (30 cm), at the quarter points when the elongated side is more than about 2 feet (30 cm) and less than about 4 feet (60 cm), and about every 12 inches (30 cm) when the elongated side is greater than about 4 feet (60 cm). A support shim 116 under the sheet retaining member 34 is also recommended to prevent the sheet retaining member from dropping between the legs of the spacer frame when the multi-sheet glazing unit incorporating features of the invention is in use.

As can be appreciated by those skilled in the art, increasing the wall thickness of the ends 90 and/or spacer frame 28 provides additional structural stability to support the sheet retaining member. However, increasing the wall thickness of the spacer frame increases thermal conductivity of the spacer frame and increases the weight of the unit. Reducing the weight of the inner sheet by making it thinner and/or from material lighter than glass e.g. plastic may be considered to eliminate the need of the shim.

Figure 3:
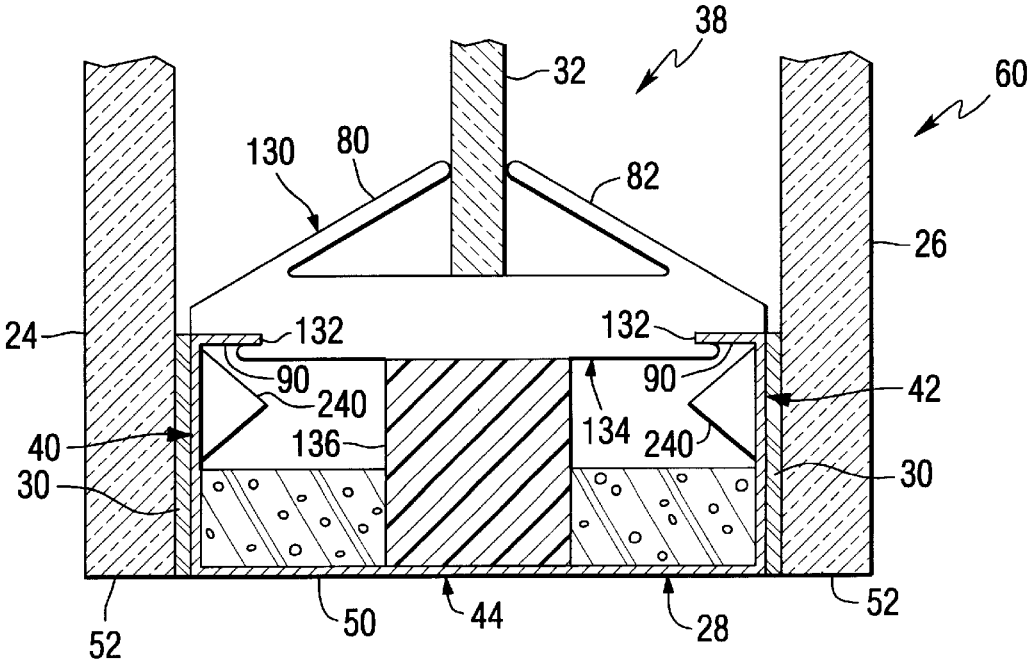
FIG. 3 is a view similar to the view in FIG. 2 illustrating another embodiment of the sheet retaining member of the instant invention.
Figure 4:
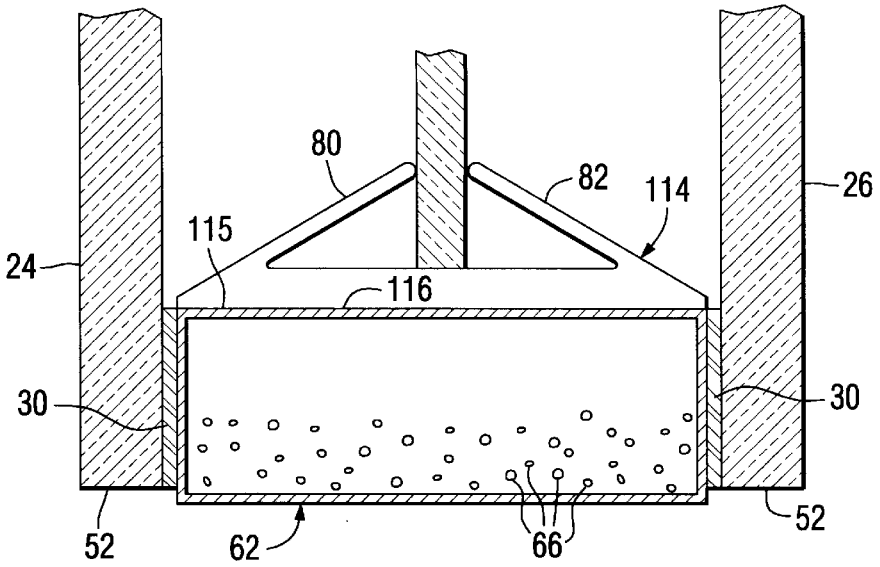
FIG. 4 is a view similar to the view of FIG. 2 illustrating still another embodiment of the sheet retaining member of the instant invention.

In FIG. 3 there is shown another embodiment of a sheet retaining member incorporating features of the invention. Sheet retaining member 130 shown in FIG. 3 has a groove 132 at each side of support member 134 to receive the ends 90 of the spacer frame in the recesses. As the retaining member 130 is moved downward as viewed in FIG. 3 between the legs of the spacer frame, the legs of the spacer frame are moved apart. As the support member 134 is seated on the ends 90 of the spacer frame 28, the ends move into the recesses 132. Further, in FIG. 3 there is shown a shim 136 having a rectangular shape.

Referring back to FIG. 2, the height of the sheet retaining member extending above the top of the spacer frame, i.e., the upper surface 140 of the support member 84 above the top of the ends 88. However, as can be appreciated, the more the upper surface of the support member extends above the top of the spacer legs; the more visible the sheet retaining member is. Further, the higher the upper surface 140 of the support platform of the sheet retaining member 34 is above the legs of the spacer, the greater the distance between the peripheral edge of the inner sheet 32 and the base of the spacer frame or the bead(s) 64. As the distance increases, air circulation between compartments 36 and 38 increases, moving the insulating gas between the compartments and setting up thermal paths. SIR H975 has a discussion regarding the spaced distance and reference may be made thereto. Although not limiting to the invention, in the practice of the invention, it is preferred that air or gas circulation is prevented at the top and/or bottom edge of the inner sheet 32. However, the invention contemplates a spacing for air or gas circulation, e.g. a distance of 0 to about ½ inch (1.27 cm) and preferably about 1/32 inch (0.08 cm).

As can now be appreciated, the spacing between the upper surface 140 of the support member 84 and the bead(s) 64 or base 68 of the spacer frame may be decreased by increasing the thickness of the bead, and/or increasing the thickness of support member to extend the underside of the support member further between the legs of the spacer frame. Further, as can be appreciated, any spacing around the edge of the sheet 32 can be eliminated by providing a sheet retaining member having a length sufficient to completely cover the elongated top or bottom side of the spacer frame as shown in FIG. 1 or as the unit is used thereby preventing any air circulation between the compartments.

The invention will be discussed to make a glazing unit similar to the unit 20 shown in FIGS. 1 and 2 having a closed spacer frame made from a continuous piece of spacer stock. Each of the outer sheets 24 and 26 are clear glass sheets having a length of about 42 ⅞ inches (108.9 centimeter, hereinafter "cm") and a width of about 19 ¾ inches (50.17 cm). The inner sheet 32 is a clear glass sheet having a length of about 42 ¼ inches (107.30 cm) and a width of about 19 ⅛ inches (48.57 cm). The outer sheets have a thickness of 0.090 inch (0.229 centimeter), and the inner sheet has a thickness of about 0.070 inch (0.178 cm).

The surface of the glass sheets 24 and 26 designated to be the inner surfaces have a coating of the type sold by PPG Industries under its registered trademark Sungate® 100 coated glass. The designated outer surfaces have a photocatalytic cleaning film of the type disclosed in U.S. patent application Ser. Nos. 08/899,257 and/or 60/040,566. The surfaces of the inner sheet 32 have a water reducing film of the type disclosed in U.S. patent application Ser. No. 08/927,130.

Figure 6:
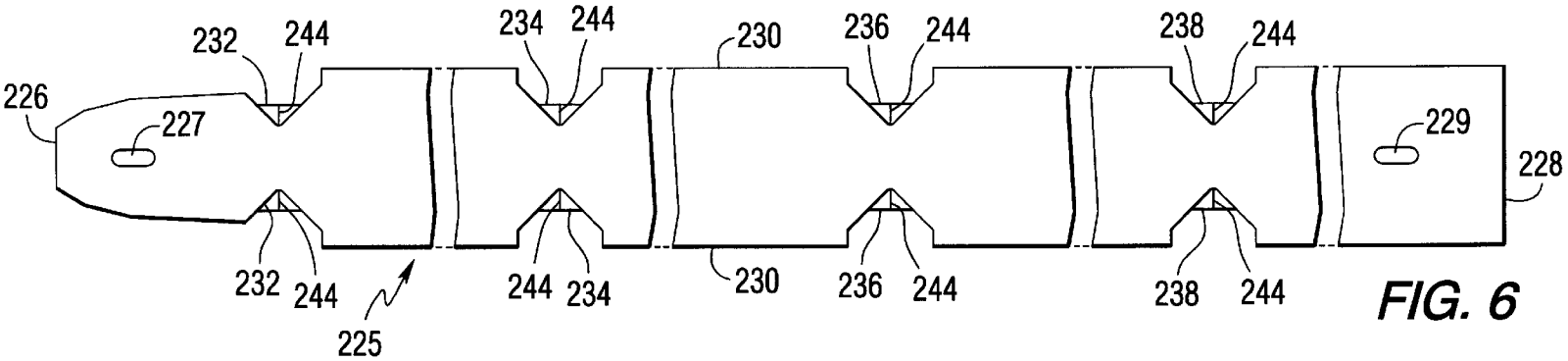
FIG. 6 is a plan view of a strip prior to shaping the strip into a spacer stock having the U-shaped cross sectional configuration shown in FIGS. 2, 3 and 7–11.
Figure 7:
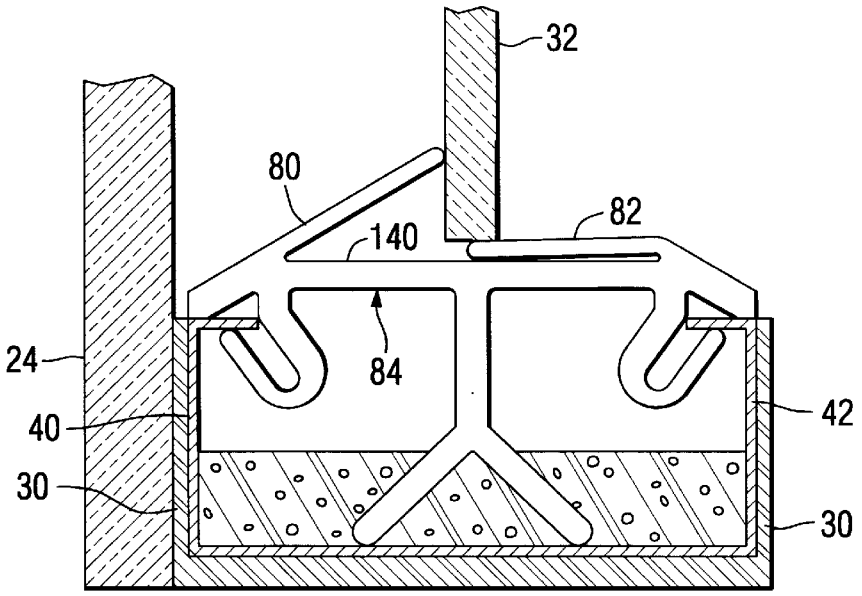
FIGS. 7 and 8 are views similar to the view of FIG. 2 showing selected steps practiced in the fabrication of a multi-sheet glazing unit incorporating features of the invention mounted in a side of a spacer frame.

A spacer frame 28 having four continuous corners is made as follows. With reference to FIG. 6, a flat tin coated steel strip 225 having a length of about 126 inches (320 cm), a width of about 1.25 inches (3.18 cm) and thickness of about 0.010 inch (0.25 mm) is die cut. After die cutting, the strip 225 as shown in FIG. 6 has a tapered and wedged end 226 having a hole 227. Opposite end 228 of the strip 225 has a hole 229. Spaced at locations about 1.5 inches (3.8 cm), about 21 ⅛ inches (53.65 cm), about 63 ⅞ inches (162.24 cm), and about 83 ½ inches (212.09 cm) from the end 126, material is removed from opposite edge portions 230 of the substrate 225 to provide sets of paired notches 232, 234, 236 and 238 respectively. The notched areas form the bent portions 240 (shown only in FIG. 3), and the notches provide for the bent portions 240 to be a sufficient distance so as not to overlap and eliminate the extension 88 of the legs 40 and 42 for ease of bending the spacer stock to provide the closed spacer frame. Crease lines 244 are provided at the notches as shown in FIG. 7 for ease of bending the subsequently formed spacer stock to form a closed spacer frame having continuous corners as disclosed in U.S. Pat. No. 's '047 and '916 which disclosures are hereby incorporated by reference.

Each of the notches of the set of paired notches 234, 236 and 238 have a length of about 0.536 inch (1.36 cm) at the edge 230 of the substrate, a depth of about 0.170 inch (0.43 cm) as measured from the edge 230 of the substrate toward the center of the substrate. The notches 232 are similar in size as the notches 234, 236 and 238 but the left side of the notch as shown in FIG. 6 is further cut to insert the end 126 into the end 128 after the strip 125 is formed into the spacer stock having a U-shaped cross section. The distance between the points of pairs of notches depends on the width of the base of the spacer frame, i.e., the desired spacing between the outer sheets. The unit has the point of the crease lines spaced about 0.500 inch (1.27 cm) from the edge 230 of the substrate to provide the base with a width of about 0.50 inch (1.27 cm) and ends 88 having an extension of about 0.078 inch (0.18 cm).

The strip 225 is shaped to provide a spacer stock having a U-shaped cross section as shown in FIG. 2. Ends 230 of the substrate 225 are bent over to form the ends 88 to provide the spacer frame with structure stability, and to secure the sheet retaining member in position as disclosed above and further discussed below. The layers 30 and 48 of the adhesive-sealant are provided on the outer surfaces 46 of the legs 42 and 44 and outer surface 50 of the base 54 of the spacer frame 28.

A bead 64 of H. B. Fuller HL 5102X-125 butyl hot melt matrix having the desiccant 66 is flowed on the inner surface 68 of the base 44 in any usual manner. Thereafter the spacer stock is bent to form a closed spacer frame. A rivet or screw (not shown) may be used to secure the ends 226 and 228 together to provide the closed frame. One of the outer sheets, e.g., the sheet 24, as shown in FIG. 7 is adhered to a leg of the spacer frame e.g. the leg 40 by the adhesive-sealant layer 30.

Eight sheet retaining members 34 of the instant invention made of plastic are provided. With reference to FIG. 5, the support surface of the sheet retaining member 34 has a length (along the length of the spacer) of about 0.5 inch (1.27 cm) and a width of about 0.656 inch (1.7 cm) as measured between the ends of the extension 88. The distance between the fingers 80 and 82 in the unbiased position e.g. the position as shown in FIG. 5 is about 0.070 inch (0.178 cm). The fingers have a thickness of about 0.020 inch (0.508 cm) and the support member has a thickness of about 0.035 inch (0.076 cm). The legs of the shim each have a thickness of about 0.035 inch (0.076 cm). The angle subtended by the fingers 80 and 82 in the unbiased position and the upper surfaces of the support member is about 30°. The horizontal distance from the end of the fingers 80 or 82 to the extension 88 as measured in the unbiased position is about 0.293 inch (0.75 cm). A sheet retaining member is mounted to the spacer frame as previously discussed at the quarter points on the long side of the spacer frame and at the mid point for the short side of the spacer frame.

Figure 8:
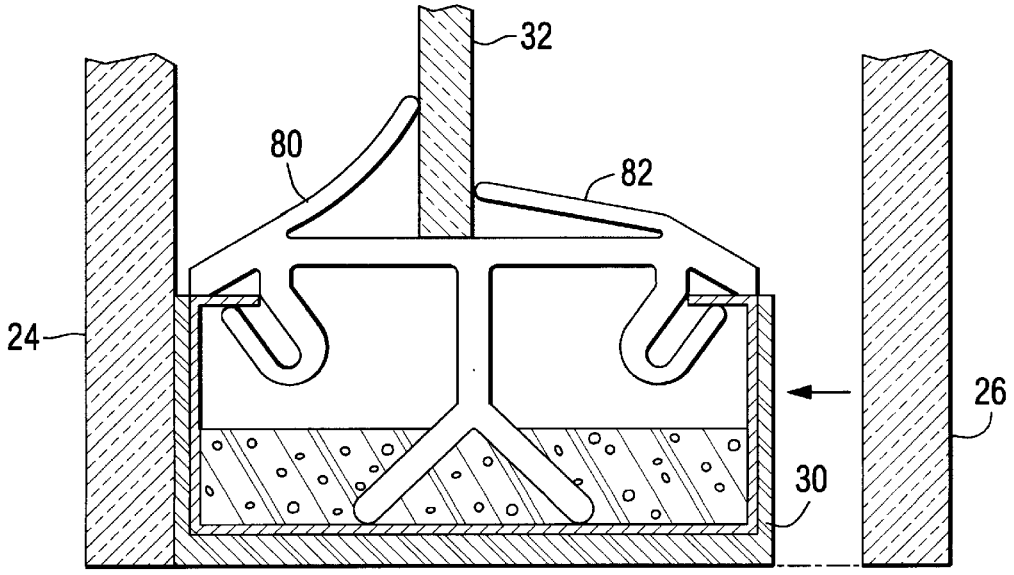

With reference to FIGS. 7 and 8, the inner sheet 32 is moved to the left as viewed in FIG. 8 biasing the finger 82 against the upper surface 140 of support platform 84 as shown in FIG. 8. The sheet 32 is further moved to the left against the finger 80 until the peripheral edge of the inner sheet clears the end of the finger 82 after which the finger 82 moves to the unbiased position as shown in FIG. 8. The inner sheet 32 is now captured between the fingers 80 and 82. Thereafter the designed inner surface of the sheet 26 is adhered to the legs 42 of the spacer frame 28 by the layer 30 of the adhesive-sealant.

The outer glass sheets 24 and 26 are now biased toward one another to flow the adhesive-sealant layer 30 to secure the outer glass sheets to the spacer frame. If the layer 48 of the adhesive-sealant is not provided on the outer surface of the spacer frame, the layer 48 of the adhesive-sealant is flowed into the channel 54 formed by the marginal edge portions of the sheets 24 and 26 and the base 44 of the spacer frame 28.

As can be appreciated, the bead 64 having the desiccant 66 may be extruded before, after, or during the extrusion of the layers 30. Further, the layer 48 may be applied during or after the strip is formed into spacer stock. Still further, as now can be appreciated, the invention is not limited to the sequence of steps to make the unit. For example, and not limiting to the invention, after the spacer frame having the bead 64 is provided, the sheet retaining members 34 are mounted on the closed frame. Thereafter the inner sheet 32 is secured in position as previously discussed, and the layers 30 and sheets 24 and 26 are mounted on the legs 40 and 42 respectively of the spacer frame.

Figure 9:
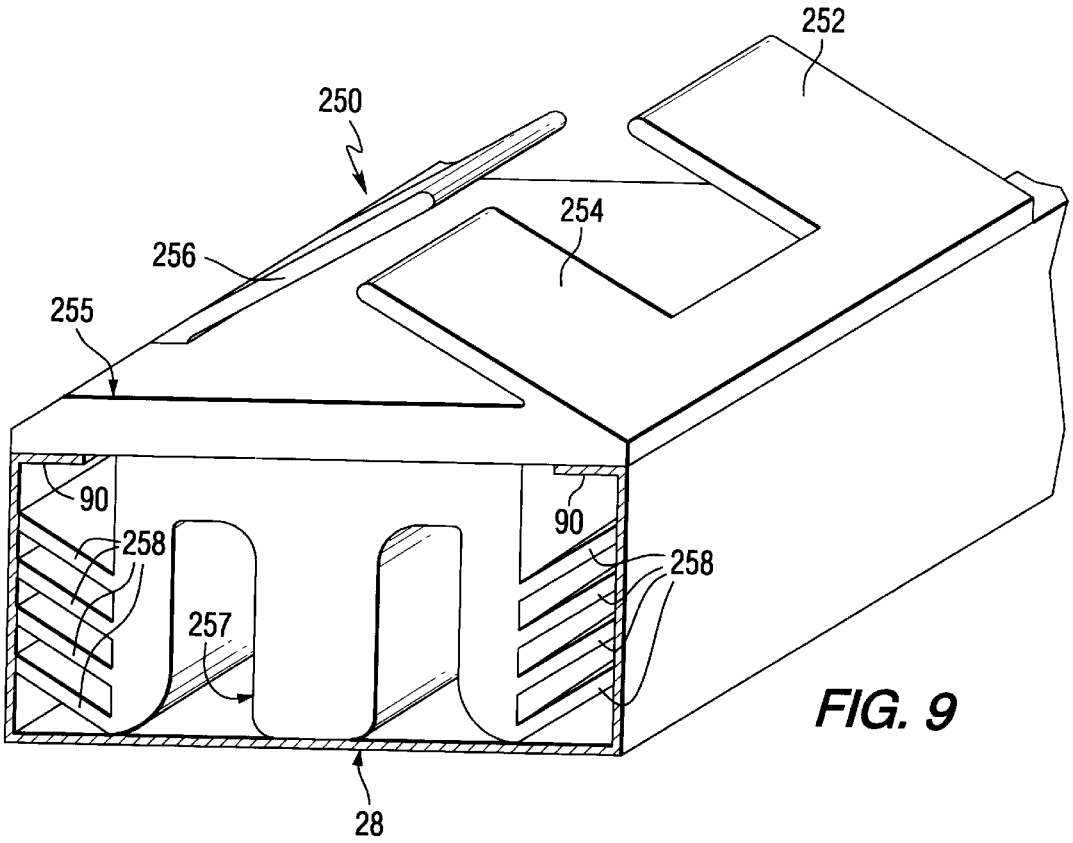
FIG. 9 is a view similar to the view of FIG. 5 showing another embodiment of a sheet retaining member of the invention.

As can now be appreciated, the invention is not limited to the number of inner sheets 32 or the number of finger of the sheet retaining member for engaging the sheet of the invention. For example, as shown in FIG. 9, sheet retaining member 250 has a pair of fingers 252 and 254 on one side of platform member 255 and one finger 256 on the other side. The sheet retaining member 250 has a shim 257 having an "M" cross section and fins 258 to capture the sheet retaining member 250 on the ends 90 of the spacer frame 28.

Figure 10:
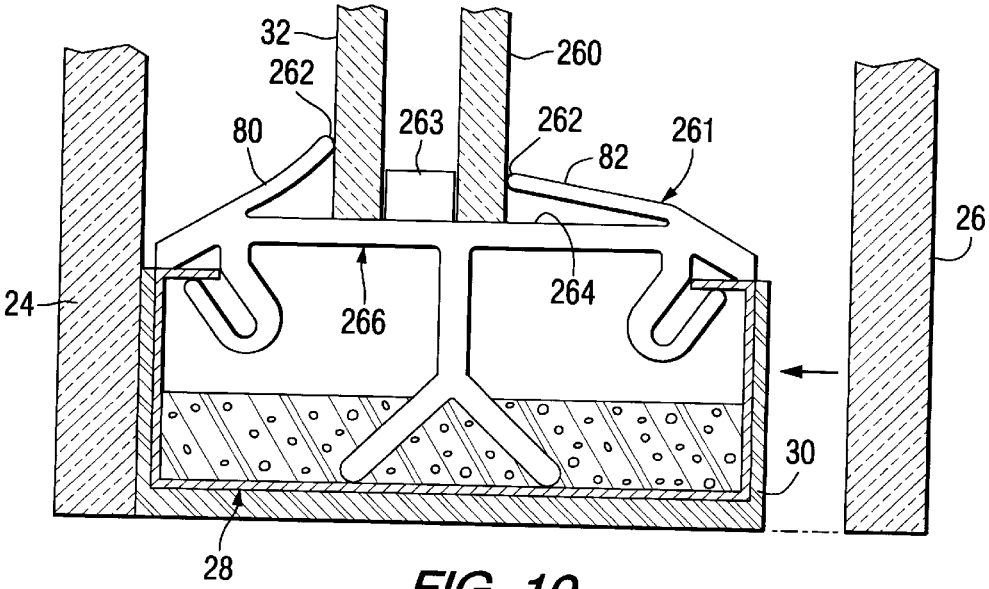
FIG. 10 is a view similar to the view of FIG. 8 showing construction of a multi sheet glazing unit of the instant invention having two inner sheets.

With reference to FIG. 10, there is shown the construction of a unit having two inner sheets 32 and 260. As shown in FIG. 10, the sheet 24 is secured to the spacer frame 28 by the layer 30 of the adhesive-sealant. Sheet retaining members 261 are secured to the spacer frame in a similar manner as the sheet retaining member 34 was secured to the spacer frame. The spacing between ends 262 of the fingers is equal to or slightly larger than the thickness of the two inner sheets 32 and 260 and the separator 263. The sheet 32 is mounted on the sheet retainer member 261 as previously discussed for mounting the inner sheet 32 on the sheet retaining member 34. The sheet separator 263 is mounted on the upper surface 264 of platform member 266, and thereafter the sheet 260 is moved to the right as viewed in FIG. 10 to move the finger 82 against the upper surface 264 of the sheet retaining member 266 and the peripheral edge of the sheet 260 against the sheet separator 263. Continued movement of the sheet 260 to the left moves the sheet separator 263 and inner sheet 32 to the right as viewed in FIG. 10 and the inner sheet 32 against the finger 80. After the peripheral edge of the sheet 260 moves past the end 262 of the finger 82, the finger 82 moves to the unbiased position, and the finger 82 moves the sheets 32 and 260, and the sheet separator 263 to the left as viewed in FIG. 10, with the sheets 32 and 260 captured between the fingers 80 and 82 and separated by the sheet separator 263. Thereafter the outer sheet 26 is mounted to the spacer frame as previously discussed.

As can be appreciated, the inner sheets 32 and 260, and the sheet separator 263 may be mounted in the sheet retainer member 261 prior to mounting one of the outer sheets to the spacer frame, and one inner sheet may be mounted from one side of the spacer frame and the other inner sheet from the other side. Further, it is recommended that the sheet separator 263 be captured on the upper surface 264 of the platform 266 for sliding movement in any convenient manner in is order that the sheet separator may be moved between the fingers as previously discussed and is prevented from falling from between the inner sheets. One technique is to provide a groove in the platform member 266 and a headed stud mounted to the underside of the sheet separator captured in the groove for sliding motion.

Figure 11:
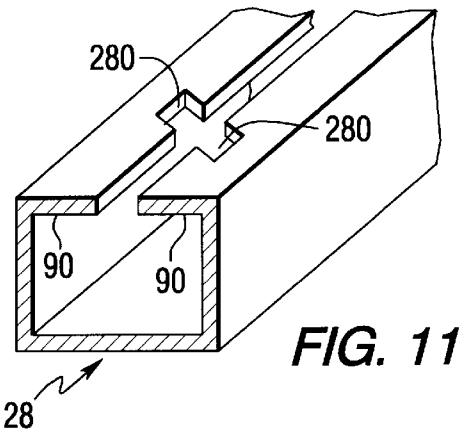
FIG. 11 is a partial isometric view of a spacer frame having cutouts for receiving a sheet retaining member incorporating feature of the invention.

As can now be appreciated, the invention is not limited to the embodiments of the glazing units or the components used in the fabrication of the units discussed above, and additional embodiments can be made within the scope of the invention. For example, and with reference to FIG. 11, the ends 90 of the spacer frame 28 have cutouts 280 to minimize sideward movement of the sheet retaining member along the elongated side of the spacer frame and for specifying location of the sheet retaining members.

The scope of the invention is only limited by the scope of the following claims.

What is claimed is:

1. A sheet retaining member comprising:

a support platform;

a pair of fingers, each finger having a first side and an opposite side designated as a second side with the first side of one finger mounted adjacent a side of the support platform and the first side of the other finger mounted adjacent the other side of the support platform with the fingers extending above an upper surface of the support platform toward one another, each of the fingers bendable adjacent their respective first side and the fingers in an unbiased position spaced from the upper surface of the support platform with the second side of each finger in a fixed relationship to one another, and securing arrangement on the support platform wherein the support platform is to be mounted on a spacer frame having at least a base lying in a plane defined as a first plane and a pair of spaced upright legs extending away from the base and terminating at a plane defined as a second plane generally parallel to the first plane and the securing arrangement is to secure the support platform on the spacer frame with the support platform in the second plane and spaced from the base.

2. A multi-sheet glazing unit comprising:

a spacer frame having at least a base and opposed legs connected to one another such that the base and legs have a generally "U" shape wherein the legs provide the spacer frame with opposed sides;

a sheet secured on each side of the spacer frame;

a sheet retaining member comprising:

a support platform mounted on the spacer frame spaced from the base of the spacer frame and between the sheets and a pair of fingers, each finger having a first side and an opposite side designated as a second side with the first side of each finger mounted to the support spaced from one another with the fingers extending over the support platform with the second side of each finger facing one another and each finger bendable adjacent its first side, and a third sheet mounted between the second end of the fingers, the third sheet mounted within the spacer frame and between the outer sheets.

3. The glazing unit according to claim 2 wherein the sheet retaining member is formed as one piece.

4. The glazing unit according to claim 2 wherein the outer legs of the spacer frame are only connected by the base and the support platform is mounted on the legs.

5. The glazing unit according to claim 4 wherein the support platform has a first surface with the fingers spaced from and over the first surface and an opposite surface defined as a second surface, the legs of the spacer frame have end portions extending over the base toward one another and further including a securing arrangement on the support platform wherein the end portions and securing arrangement cooperate with one another to secure the support platform on the outer legs of the spacer frame.

6. The glazing unit according to claim 4 further including a shim mounted between the legs of the spacer frame and between the support platform of the sheet retaining member and the base of the spacer frame.

7. A multi-sheet glazing unit comprising:

a spacer frame having a base and opposed legs connected to one another to have a generally "U" shape;

a sheet secured on outer surface of each of the opposed legs;

support platform mounted on the spacer frame spaced from the base and between the sheets;

a sheet engaging member mounted on the support platform between the sheets to provide a sheet retaining member, the sheet retaining member having a pair of flexible fingers, each finger having a first side and an opposite side designated as a second side with the first side of each finger mounted to the sheet engaging member spaced from one another with the fingers extending over the support platform with the second side of each finger facing one another, wherein each elongated side of the spacer frame has at least one sheet retaining member and a third sheet mounted between the second end of the fingers between the outer sheets.

8. The glazing unit according to claim 7 wherein each elongated side of the spacer frame has at least two sheet retaining members spaced from one another.

9. The glazing unit according to claim 2 wherein the unit has at least two compartments between the sheets secured on the legs of the spacer frame and further including a water reducing film on at least one major surface facing at least one of the compartments.

10. The glazing unit according to claim 2 wherein the outer surface of at least one of the outer sheets includes a photocatalytic film.

11. The glazing unit of claim 2 further including another sheet between the fingers and spaced from the third sheet by a sheet separator.

12. The glazing unit according to claim 2 wherein the sheets are glass sheets, and the spacer frame is made of metal.

13. The glazing unit according to claim 2 wherein selected major surfaces of the sheets have a coating to selectively pass selected ultraviolet wavelengths of the ultraviolet visible and/or infrared.

14. The sheet retaining member according to claim 1 wherein the spacer frame has a U shaped cross section, the second plane is defined by each of the legs spaced from the base, the securing arrangement maintains the platform on the upper end of the legs spaced from the base and further including a support member extending from and away from the base to provide support to prevent the support platform from dropping between the legs of the spacer frame.

15. The sheet retaining member according to claim 1 wherein the support platform has a surface defined as a second surface opposite the first surface and the securing arrangement includes a pair of opposite grooves formed in the support platform between the first and second surfaces.

16. The sheet retaining member according to claim 1 wherein the support platform has a surface defined as a second surface opposite the first surface and the securing arrangement includes flexible fingers mounted on the second surface of the support platform.

17. The glazing unit according to claim 5 wherein the securing arrangement includes grooves formed in the side of the support platform between the upper and lower surfaces wherein the grooves receive the end portions of the legs of the spacer frame.

18. The glazing unit according to claim 5 wherein the securing arrangement includes flexible fingers mounted on the second surface of the support platform and engagable with the end portions of the legs of the spacer frame.

19. The glazing unit according to claim 17 wherein the end portions of the legs of the spacer frame each have notches and the securing arrangement are tabs which are received by the notches.

20. The glazing unit according to claim 18 wherein the end portions of the legs of the spacer frame each have notches and the securing arrangement are tabs which are received by the notches.

21. The glazing unit according to claim 2 wherein the end portions of the legs of the spacer frame each have notches and the securing arrangement are tabs which are received by the notches.

22. A method of making a multi-sheet glazing unit comprising the steps of:

providing a spacer frame having at least a base and opposed legs connected to one another such that the base and legs have a generally "U" shape wherein the legs provide the spacer frame with opposed sides;

providing at least two sheet retaining members on the spacer frame spaced from and opposite to the base of the spacer frame with the sheet retaining members opposite one another on the spacer frame, at least one of the sheet retaining members comprising:

a support platform mounted on the spacer frame spaced from the base of the spacer frame and between the sheets and a pair of fingers, each finger having a first side and an opposite side designated as a second side with the first side of each finger mounted to the support spaced from one another with the fingers extending over the support platform with the second side of each finger facing one another with each finger bendable adjacent its first side;

mounting an inner sheet between the second end of the fingers of the sheet retaining member, the third sheet mounted within the spacer frame and the sides of the spacer frame, and securing a sheet on each side of the spacer frame.

23. The method of claim 22 wherein the step of mounting the inner sheet comprises the steps of:

biasing the inner sheet against one of the fingers of the at least one of the sheet members to move the finger toward the support platform;

continuing the practice of the biasing step until the sheet has passed the second end of the finger moved toward the platform, and discontinuing the biasing step.

24. The method as set forth in claim 23 wherein the multi-sheet glazing unit has two compartments between the three sheets and further comprising the step of providing a layer of a moisture-pervious adhesive having a desiccant therein communicating with each compartment.

25. The method as set forth in claim 24 wherein the spacer frame has a rectangular shape, said mounting stop includes the step of mounting at least one sheet retaining member on each side of the spacer frame.

26. The method as set forth in claim 25 wherein the sheet on each side of the spacer frame is a first sheet and a second sheet and the inner sheet is a third sheet further comprising the steps of after the practice of the biasing step, positioning a sheet separator on the platform;

providing a fourth sheet;

practicing the biasing step, the continuing step and the discontinuing step using the fourth sheet, and practicing the securing step.

* * * * *